United States Patent [19]

Vallarino et al.

[11] 4,447,525

[45] May 8, 1984

[54] PROCESS FOR PROVIDING A MATT SURFACE ON A PHOTOGRAPHIC MATERIAL AND PHOTOGRAPHIC MATERIAL PROVIDED WITH SUCH MATT SURFACE

[75] Inventors: Angelo Vallarino, Ferrania; Lorenzo Vittore, Montenotte, both of Italy

[73] Assignee: Minnesota Mining and Manufacturing Company, St. Paul, Minn.

[21] Appl. No.: 419,403

[22] Filed: Sep. 17, 1982

[30] Foreign Application Priority Data

Sep. 23, 1981 [IT] Italy ..... 49351 A/81

[51] Int. Cl.[3] ..... G03C 1/78

[52] U.S. Cl. ..... 430/539; 430/950; 430/523

[58] Field of Search ..... 430/539, 950, 523

[56] References Cited

U.S. PATENT DOCUMENTS 3,411,907 11/1968 Whitmore et al. ..... 430/950
3,811,924 9/1974 Gallagher et al. ..... 430/950
4,142,894 3/1979 Hori et al. ..... 430/950
4,266,010 5/1981 Nagatomo et al. ..... 430/950

*Primary Examiner*—Jack P. Brammer
*Attorney, Agent, or Firm*—Donald M. Sell; James A. Smith; Mark A. Litman

[57] ABSTRACT

A matt surface can be provided on a photographic material comprising a support base, one or more light-sensitive gelatin silver halide emulsion layers and an outer non-light-sensitive gelatin layer coated on said layers if discrete particles, insoluble in water and substantially soluble in aqueous alkaline medium, of a carboxyl group containing copolymer are introduced into said outer layer. The particles, of a diameter between 0.5 and 4 micron, are introduced into the coating composition of the outer layer as a dispersion of a methacrylic acid and ethylmethacrylate copolymer containing 20 to 50 percent by weight of methacrylic acid, which dispersion is obtained by dispersing in an aqueous solution of a hydrophilic colloid a solution of said copolymer in ethylacetate or water-including ethylacetate.

6 Claims, No Drawings

PROCESS FOR PROVIDING A MATT SURFACE ON A PHOTOGRAPHIC MATERIAL AND PHOTOGRAPHIC MATERIAL PROVIDED WITH SUCH MATT SURFACE

FIELD OF THE INVENTION

The present invention refers to photographic elements having incorporated therein water-insoluble and aqueous alkali-soluble discrete particles of matting agents and to a method for introducing said particles into photographic elements.

BACKGROUND OF THE ART

In the field of photography, water-insoluble matting agents have been used in top layers or back layers of photographic materials to prevent adhesion when materials are stored in the rolled state in conditions of relatively high humidity and temperature, to prevent electrostatic charges by reducing the area of contact of the photographic material, to prevent the formation of Newton's rings during printing and enlargement, or to decrease the occurrence of scratches during storage or packing of the photographic material.

It is known that matting agents insoluble in alkaline processing solutions, such as silica and polymethylmethacrylate, remain in the processed photographic material. The photographic material therefore has a slightly milky appearance which detracts from the image formed therein.

To avoid such problems, matting agents which are insoluble in neutral or acid solutions and are soluble in alkaline medium have been described in the art. Such matting agents are incorporated in the photographic layers in the form of discrete particles by dispersing a solution of the matting agent in a water-immiscible organic solvent in an aqueous gelatin solution, eliminating the organic solvent, and then introducing the obtained dispersion into the coating composition of the photographic layer. Organic solvents or combinations thereof have been studied with the copolymers of methylmethacrylate and methacrylic acid, the basic solvent being butanol and mixtures thereof with other solvents. Since however butanol is a low volatile solvent, it must be removed by cooling the dispersion and washing it with deionized water. A part of the solvent remained even after prolonged washing of the dispersion which also retained an objectionable odor. Furthermore, industrial water could not be used in the washing because cations present therein caused substantial dissolution of the polymeric particles.

SUMMARY OF THE INVENTION

Now, it has been found that, using copolymers off ethylmethacrylate and methacrylic acid, dispersions can be obtained in gelatin using ethylacetate or water-including ethylacetate (up to the saturation point of water) as solvent if the copolymer contains from 20 to 50 percent by weight of methacrylic acid. These copolymers dissolve in high concentrations of ethylacetate or water-including ethyl acetate (up to saturation), a solvent which either can be easily removed by evaporation from the dispersion of the copolymer in gelatin or can be left in the dispersion, since the addition thereof to the coating composition of the photographic layer causes neither physical, nor sensitometric harmful effects.

It has been found in particular that by varying the percentage or methacrylic acid within the limits above, it is possible to control the solubility of the polymeric particles in the solution of the photographic process. Total solubility can be approached for the copolymers which have higher percentages of methacrylic acid. Partial, but useful solubility can be achieved for the copolymers which in the above limits have lower percentages of methacrylic acid. A partial solubility useful in photographic materials is desired when a portion of the matting agent is to be present after processing. Copolymers having percentages of methacrylic acid outside the limits described above proved to be useless to the purpose of the present invention, since they were either insoluble in ethylacetate or water-including ethylacetate (up to saturation) if percentages of methacrylic acid higher than 50 were present therein, or either very poorly soluble or totally insoluble in the photographic processes if percentages of methacrylic acid lower than 20 were present therein. Minor quantities of unsaturated vinylmonomer units other than methacrylic acid and ethylmethacrylate, well-known in the art for their capability of copolymerizing with the two above monomers, such as acrylonitrile, vinylacetate, styrene, ethylvinylether and butylvinylether, can also be present the the copolymer chain provided they do not negatively affect its properties to the purposes of the present invention. Since the copolymer structure and characteristics are not to be changed by the introduction of such minor (preferably less than 5 percent ) proportions of said additional units, the language "copolymer" is herein maintained to include the polymer which is formed by said two main monomers and said minor proportions of additional monomers. However, unless there is any specific advantage or need to introduce such minor additional units, it is preferred not to introduce them into the copolymer chain.

DETAILED DESCRIPTION OF THE INVENTION

Accordingly, the present invention relates to a method for providing matt surfaces on a photographic material, comprising a support base, one or more light sensitive gelatin silver halide emulsion layers and an outer light-insensitive gelatin layer, by introducing into the outer layer discrete particles insoluble in water and substantially soluble in alkaline processing solutions. The particles comprise a carboxyl group containing copolymer, and the method is characterized by the fact that the copolymer of methacrylic acid and ethylmethacrylate contains from 20 to 50 percent in weight of methacrylic acid and is dissolved in ethyl acetate. The copolymer solution is dispersed in an aqueous solution of a hydrophilic colloid in the form of finely divided particles having average diameters from 0.5 to 4 micron, and the dispersion is introduced into the coating composition of the outer light-insentive layer.

According to another aspect, the present invention relates to a photographic material comprising a support base, one or more light-sensitive gelatin silver halide emulsion layers and an outer light-insensitive gelatin layer containing incorporated in the outer layer discrete particles, insoluble in water and substantially soluble in alkaline processing solutions, said particles comprising a carboxyl group containing copolymer in a matting amount, wherein said discrete particles comprise a copolymer of methacrylic acid and ethylmethacrylate containing from 20 to 50 percent in weight of methacrylic acid.

The present invention preferably refers to a photographic material as heretofore described, wherein said discrete particles have average diameters from about 0.5 to about 4 micron. Preferably, the present invention relates to a photographic material as heretofore described, wherein the discrete particles are present in an amount from about 50 to 600, more preferably from about 150 to about 400 mg. per square meter of said photographic material.

The present invention particularly refers to a photographic material as heretofore described, wherein the outer light-insensitive gelatin layer, comprising incorporated therein said discrete particles, is an outer protective layer coated on a light-sensitive gelatin silver halide layer and/or a layer coated on the back of the support base.

More particularly and preferably, the present invention relates to a photographic material as heretofore described, wherein the gelatin light-sensitive silver halide emulsion layers are sensitized to different regions of the visible spectrum and associated with dye forming couplers.

According to a further aspect, the present invention relates to a photographic material as heretofore described, additionally comprising discrete particles of matting agents insoluble in water and in the alkaline processing solutions in combination with said water-insoluble and alkali-soluble discrete particles.

The copolymers of ethylmethacrylate and methacrylic acid used in the present invention can be prepared using conventional methods. In general, the copolymerization is carried out by heating at a proper temperature (which usually does not exceed 100° C. and preferably is between 50° C. and 100° C.) in a proper solvent (usually ethanol or methanol) a mixture of the two monomers in a proper concentration with respect to the solvent (usually at a concentration that does not exceed 40 percent in weight of the two monomers with respect to the solvent, preferably between 10 and 25 percent) in the presence of a polymerization catalyst (for example of the free radical type, such as benzoyl peroxide or cumene hydroperoxide, or of the azoic type, such as $\alpha,\alpha'$-azobisisobutyrronitrile). The obtained copolymer can be then separated from the reaction mixture for example by precipitating into a non-solvent, such as water and drying.

The copolymers useful in the present invention have a percentage in weight of units derived from methacrylic acid between 50 and 20 percent. The people skilled in the art can obtain easily copolymers of ethylmethacrylate and methacrylic acid having the desired percentage of methacrylic acid by varying properly the composition of the monomer mixture in the copolymerization.

It has been found that the ethylacrylatemethacrylic acid copolymers of the present invention are soluble in a high concentration (up to 25%) in water-saturated ethylacetate and that the copolymers having a lower percentage of methacrylic acid within the above reported range result to be soluble in a high concentration (up to 25%) also in ethylacetate without water.

The copolymers of the present invention are introduced into the photographic layers in the form of finely dispersed, substantially spherical small particles. These particles can be formed by dispersing a solution of the copolymer in ethylacetate or water-including ethylacetate into an aqueous gelatin solution under fast stirring. The copolymer remains divided in the gelatin in the form of finely dispersed rounded granules. The particles can vary in diameter from 0.2 to 10 micron, preferably from 0.5 to 5 micron. With appropriate changes in making the dispersion, the applicant has found that it is possible to obtain dispersions having narrow distribution curves of the particle sizes with proper average diameters according to the particular needs of the photographic material. For example, by dispersing the solution in ethylacetate or water including ethylacetate of the copolymer directly into the aqueous gelatin solution, distribution curves of the particle sizes with average diameters of about 1 micron are obtained. By dispersing first the organic solution of the copolymer in water, then adding this dispersion into a gelatin solution and quickly stirring, distribution curves of the particle sizes with average diameters of about 3–4 micron are obtained.

The obtained dispersions, before being added to the coating composition of the photographic layer in which they must be incorporated, can be freed of the ethylacetate by heating at about 50° C. under air ventilation or can be used as they are. Dispersions freed or ethylacetate as described above substantially retain the distribution curve of particle sizes without formation of aggregates. Dispersions containing ethylacetate in the photographic layers cause neither physical nor sensitometric harmful effects.

In order to disperse the above described copolymer solutions, an aqueous medium comprising gelatin as stabilizer has generally been used. Other hydrophilic colloids, such as gelatin derivatives, proteins, cellulose derivatives, collodion, alginic acid and synthetic high-molecular weight polymers can also be used. Among these materials, gelatin and gelatin derivatives are particularly preferred. Surface active agents, which usually are employed to stabilize dispersions for use in photography, according to the applicant's experiments, have not proved to be generally useful to the preparation of the present invention copolymer dispersions, though their presence is not harmful.

The discrete particles of the water-insoluble copolymers of the present invention are present in the outer layers of the photographic layer before processing and, by rendering coarse the surface thereof, are useful to prevent adhesion, to reduce the occurrence of electrostatic charges and to prevent abrasion.

When these copolymers are substantially soluble in the photographic alkaline processing solutions, very smooth and transparent surfaces are obtained after complete processing. This is particularly important for those photographic materials which have a paper support base and must be examined by reflection and for those photographic materials which have a transparent support base and might be employed in enlargement and printing operations.

The quantity range of methacrylic acid in the ethylmethacrylate and methacrylic acid copolymers of the present invention has been selected to meet the needs of solubility thereof in ethylacetate or water-saturated ethylacetate and in the photographic processings. Copolymers having less than 20 percent in weight off methacrylic acid have some solubility in ethylacetate, but are insoluble in the photographic processing baths; copolymers having more than 50 percent of methacrylic acid are soluble in the photographic processing baths, but insoluble in ethylacetate or water-including ethylacetate. Moreover, within the quantity range of methacrylic acid, it has been found that it is possible to vary the percentage of particles which dissolve in a given photographic developing bath. Copolymers having within the considered range higher percentages of methacrylic acid are dissolved in the photographic developing baths completely, while copolymers having within the considered quantity range lower percentages of methacrylic acid are dissolved in said baths partially. For example, copolymers dispersed in the outer protective layer of the photographic material, with a percentage of methacrylic acid higher than 40 per cent, have been found to dissolve completely in the conventional developing baths for color negative films, while copolymers having a percentage of methacrylic acid of about 30 percent have been found to dissolve partially, thus leaving in the photographic material at the end of the processing 30–40 percent of the particles present prior to the processing. This can be particularly useful in those cases, as with color negative films, where a part of the matting agent left in the material after processing makes some operations easier, such as for instance the retouching of the negative, and removes Newton's rings which form during enlargement and printing.

The ethylmethacrylate-methacrylic acid copolymers containing from 20 to 50 percent in weight of methacrylic acid of the present invention proved to be particularly useful since they can be easily introduced into the photographic materials and can be employed with versatility according to photographic material needs. Above all, they are highly desirable if compared with matting agents soluble in the processing baths known in the art, such as the methylmethacrylate-methacrylic acid copolymers, described for instance in U.S. Pat. No. 4,142,894 and G.B. Pat. No. 878,520, which are soluble in n-butylic alcohol and insoluble in ethyl acetate. The butyl-methacrylate-methacrylic acid copolymers, even if soluble in ethylacetate, when dispersed in the outer layers of the photographic material, tend to increase, rather than to avoid, adhesion (the particles dispersed in the layers tend to get squashed, since they are softer than ethylmethacrylate-methacrylic acid copolymers).

The copolymers of the present invention are incorporated into the outer layers of the photographic material. They can be for instance incorporated into the surface protective layer coated on the silver halide emulsion layers, or into the backing layer coated on the support base on the side opposite to that containing the light-sensitive layers, or on both sides. It is more preferred, in any case, to incorporate the copolymers of the present invention into the outer protective layer.

In the photographic materials of the present invention, the ethylmethacrylate-methacrylic acid copolymers are incorporated in a quantity of about 50 to about 600 mg., more preferably from about 150 to about 400 mg. per square meter of the surface layer. The binding material of such layer preferably is gelatin, but treated gelatins like the so-called acid or basic gelatins, the gelatins treated with enzymes, gelatin derivatives and modified gelatins can also be used.

Several additions, such as hardeners, plasticizers, surfactants, antistatic agents, polymeric latexes, anticalcium and antispot agents can be incorporated into said surface layer, as known in the art.

In combination with the discrete particles of the matting agents characterized by the ethylmethacrylate-methacrylic acid polymers of the present invention, the surface layer of the photographic material can also contain discrete particles of matting agents insoluble in water and in the photographic processings, such as for instance fine silica, polymethylmethacrylate, starch particles, and the like. Such matting agents, known in the art, are to be used in the outer layer in a quantity lower than that of the copolymers of the present invention, for instance in a quantity up to 50 mg. per square meter, preferably from 5 to 10 mg. per square meter, since they remain in the photographic material after processing.

Preferably, the copolymers of the present invention can be used in color photographic elements which comprise a plurality of hydrophilic (i.e. permeable to the water photographic processing solutions) emulsion layers containing silver halides dispersed in gelatin, associated with auxiliary hydrophilic gelatin layers (filter layers, outer protective layers, interlayers, antihalo layers, backing layers), said plurality of layers being coated onto a hydrophobic support base.

Such silver halide emulsions are sensitive (or sensitized) to the blue and associated with non-diffusing yellow-forming couplers (upon color development with p-phenylene diamine after exposure), or are sensitized to the green and associated with non-diffusing magenta (blue-red) forming couplers, or sensitized to the red and associated with non-diffusing cyan (blue-green) forming couplers.

The photographic element can contain silver halide emulsions, chemical sensitizers, spectral sensitizers and desensitizers, optical brightners, antifoggants and stabilizers, couplers, acutance dyes, hydrophilic colloids and gelatin substituents, coating aids, hardeners, plasticizers and antistatic agents, as known to the man skilled in the art and can be prepared by following known coating techniques applied to known support bases, as described in Research Disclosure, December 1978, 17643, which is incorporated herein as reference.

The photographic element of the present invention, after exposure, are processed to form a visible image upon association of the silver halide with an alkaline water medium in the presence of a developing agent contained in the medium or in the element, as known in the art. In the case of color photographic elements, the processing comprises at least a color developing bath and, optionally, a pre-hardening bath, a neutralizing bath, a first (black and white) developing bath, etc. These and other baths which complete the photographic processing (e.g. bleaching, fixing, bleach-fixing, intensifying, stabilizing and washing baths) are well-known in the art and are described for instance in Research Disclosure 1978, 17643, incorporated as described above as reference.

The present invention is now illustrated by the following examples.

EXAMPLE 1

360 g. (4.18 moles) of methacrylic acid, 440 g. (3.86 moles) of ethyl methacrylate, 32 g. of $\alpha,\alpha'$-azobisisobutyrronitrile (AZBN) and 4,000 ml. of ethanol were charged into a 3-necked flask. The solution was reflux-heated for 17 hours. The obtained polymer was then precipitated by pouring the alcoholic solution into a large volume of water under vigorous stirring. The separated polymer was filtered, washed with water and dried at 60° C. in the air. The yield was 742 g. (93% of the theoretic yield). The methacrylic acid weight content in the copolymer was 43%. The polymer resulted to be soluble up to 25% in ethylacetate saturated with water (5%). The intrinsic viscosity in ethanol at 25° C. was 0.15 ml/g.

EXAMPLE 2

280 g. (3.25 moles) of methacrylic acid, 520 g. (4.56 moles) of ethylmethacrylate, 32 g. of AZBN and 4,000 ml of ethanol were charged and treated as said in Example 1. The yield was 752 g. (94%) of a copolymer having a methacrylic acid content of 33%, soluble in ethylacetate-water (95:5) with an intrinsic viscosity at 25° C. in ethanol of 0.14 ml/g.

EXAMPLE 3

200 g. (2.32 moles) of methacrylic acid, 600 g. (5.26 moles) of ethylmethacrylate, 32 g. of AZBN and 4,000 ml of ethanol were treated as described in Example 1. The yield was 760 g. of a copolymer having a methacrylic acid content of 24%, soluble up to 25% in ethylacetate, with an intrinsic viscosity in ethanol at 25° C. of 0.12 ml/g.

EXAMPLE 4

120 g. of a 25% solution of the copolymer of Example 3 in ethylacetate were dispersed in a 6% water solution of gelatin at 43° C. with a Silverson type very fast homogenizer. After 10 minutes of stirring, the dispersion was slowly stirred at 50° C. under air ventilation for about 2 hours to strip out the ethylacetate. The bead dispersion was then filtered and added with water up to a final volume of 500 ml containing 30 g. of the copolymer. The copolymer beads had an average diameter of about 1 $\mu$.

EXAMPLE 5

120 g. of a 25% solution of the copolymer of Example 1 in ethylacetate-water (95:5) was dispersed according to the procedure described in Example 4. The final dispersion contained copolymer beads having an average diameter of about 1 $\mu$.

EXAMPLE 6

120 g. of a 25% solution of the copolymer of Example 1 in ethylacetate-water (95:5) were dispersed in 200 ml of water at room temperature with a fast homogenizer. After 20 minutes of stirring, 300 g. of a 6% solution of gelatin were added to the dispersion and the stirring was continued for other 10 minutes. The dispersion was then treated as described in Example 4. The final dispersion contained polymer beads having an average diameter of 3≃4 $\mu$.

EXAMPLE 7

The same procedure of Example 6 was followed with a 25% solution of the copolymer of Example 2 in ethylacetate-water (95:5), thus obtaining copolymer beads of 3≃4 $\mu$ average diameter.

EXAMPLE 8

A multilayer color photographic element (Element A) for use as color paper for printing of color negatives was prepared by coating a resin coated paper support with the following layers in the indicated order:

First layer: A gelatin silver bromo-chloride blue-sensitive emulsion layer containing 0.4 g. of silver per sq.m. and a dispersed two-equivalent yellow coupler.

Second layer: A gelatin layer containing dispersed 2,5-diisoctylhydroquinone.

Third layer: A gelatin silver bromo-chloride green-sensitive emulsion containing 0.38 g. of silver per sq.m. and a dispersed magenta coupler.

Fourth layer: A gelatin layer containing dispersed 2,5-diisoctylhydroquinone.

Fifth layer: A gelatin silver bromo-chloride red-sensitive emulsion layer containing 0.28 g. of silver per sq.m. and a dispersed cyan coupler.

Sixth layer: A protective layer of 1 g. of gelatin per sq.m.

A second element (Element B) was prepared similarly to Element A, but having incorporated in the outer protective layer beads of polymethylmethacrylate having average diameters of 0.5–1 $\mu$ in an amount of 0.0135 g/g of gelatin.

A third element (Element C) was prepared similarly to Element A, but having incoporated in the outer protective layer beads of the copolymer of Example 1 dispersed according to Example 5 in an amount of 0.027 g/g of gelatin.

Samples of the three elements were light exposed and developed at maximum density in the following sequence:

| | |
|---|---|
| Developer | 3'30" at 32.8° C. |
| Bleach-Fix | 1'30" at 32.8° C. |
| Washing | 3'30" at 32.8° C. |

the developer and the bleach-fix bath having the following composition:

| | |
|---|---|
| Developer (composition for 1 liter at pH 10.15): | |
| ethylenglycol | 33.6 ml |
| benzyl alcohol | 14.4 ml |
| hydroxylamine-hydrochloride | 2.2 g |
| potassium methabisulfite | 1.6 g |
| 4-amino-N—ethyl-N—($\beta$-methansulfonamidoethyl)-m-toluidine sesquisulfate.$H_2O$ | 5.6 g |
| KOH 35% | 7.0 ml |
| diethylentriamino-pentacetic acid | 1.28 g |
| dipropanolaminotetracetic acid | 1.2 g |
| $K_2CO_3$ | 26 g |
| Bleach-Fix (composition for 1 liter at pH 6.75): | |
| ammonium thiosulfate | 130 g |
| ammonium metabisulfite | 10 g |
| EDTA.Fe.$NH_4$ | 65 g |
| EDTA | 4 g |

The brilliance of the black tones at highest density was evaluated on the samples thus processed. In the samples of the above elements, the number of particles prior to and after processing and the dry scratchability prior to processing were evaluated. The results are reported in the following table:

TABLE 1

| | Particles number per 2.55 cm$^2$ | | Dry scratchability prior to processing | | |
|---|---|---|---|---|---|
| Elem. | Prior to process. | After proc. | 80 g. | 160 g. | Brilliance |
| A | — | — | 26.5 | 34.5 | very good |
| B | 40 | 40 | 39 | 37 | very bad |
| C | 60 | — | 38 | 37 | very good |

EXAMPLE 9

A multilayer color photographic element (Element A) for use as color negative film was prepared by coating a cellulose triacetate subbed base with the following layers in the indicated order:

First layer: Antihalo layer with 4.05 g. of gelatin per sq.m., containing black colloidal silver in a quantity of 0.2 g. per sq.m.

Second layer: Low red-sensitivity silver bromo-iodide emulsion layer (consisting of a silver bromo-iodide gelatin emulsion containing 7.2% silver iodide moles), having a dry thickness of 3.7 μ and containing 1.25 g. of silver per sq.m. and a naphthol cyan coupler and a naphthol colored cyan coupler dispersed in a tricresylphosphate and dibutylphthalate mixture.

Third layer: High red-sensitivity silver bromo-iodide emulsion layer (consisting of a silver bromo-iodide gelatin emulsion containing 7.2% silver iodide moles), having a dry thickness of 1.5 μ and containing 0.7 g. of silver per sq.m. and a phenol cyan coupler and the same naphthol colored cyan coupler of the second layer dispersed in tricresylphosphate.

Fourth layer: Layer of 1.3 g. of gelatin per sq.m. containing 2,5-diisoctylhydroquinone dispersed in triphenylphosphate and dibutylphthalate and having a dry thickness of 1.3 μ.

Fifth layer: Low green-sensitivity silver bromo-iodide emulsion layer (consisting of a silver bromo-iodide gelatin emulsion containing 7.2% silver iodide moles), having a dry thickness of 4.0 μ and containing 2.0 g. o silver per sq.m. and a pyrazolone magenta coupler, a colored magenta pyrazolone coupler and a DIR magenta coupler dispersed in tricresylphosphate.

Sixth layer: High green-sensitivity silver bromo-iodide emulsion layer (consisting of a silver bromo-iodide gelatin emulsion containing 7.2% silver iodide moles), having a thickness of 1.9 μ and containing the same magenta coupler, the colored coupler and the DIR coupler of the fifth layer dispersed in tricresylphosphate.

Seventh layer: Layer of 1.04 g. of gelatin per sq.m., containing yellow colloidal silver and 2,5-diisoctylhydroquinone dispersed in tricresylphosphate, having a thickness of 1.2 μ.

Eighth layer: Blue-sensitive bromo-iodide emulsion layer (consisting of 40% of a low-sensitivity silver bromo-iodide emulsion containing 7.2% silver iodide moles and 60% of a still lower sensitivity silver bromo-iodide emulsion containing 2% silver iodide moles) having a dry thickness of 4.0 μ and containing 0.91 g of silver per sq.m. and a 4-equivalent yellow coupler dispersed together with a 2-equivalent yellow coupler in a tricresylphosphate and diethyllauramide mixture.

Ninth layer: High blue-sensitivity silver bromo-iodide emulsion layer (consisting of a silver bromo-iodide gelatin emulsion, containing 7.2% silver iodide moles), having a dry thickness of 1.9 μ and containing 0.56 g. silver per sq.m and the 2-eqivalent yellow coupler and the 4-equivalent yellow coupler of the eighth layer dispersed in the tricresylphosphate and diethyllauramide.

Tenth layer: Layer of 1.46 g. of gelatin per sq.m. having a dry thickness of 1.2 μ and containing the 2-(2'-hydroxy-3',5'-ditert.-amylphenyl)-benzotriazole UV-absorber dispersed in dibutylformamide.

Eleventh layer: Layer of 0.77 g. of gelatin per sq.m. having a dry thickness of 1.0 μ and containing polymethylmethacrylate particles having mean dimensions of 2–4 μ.

A second element (Element B) was prepared likewise Element A, but the eleventh layer contained beads of the copolymer of Example 1, dispersed according to Example 6, in an amount of 0.15 g. per sq.m., instead of polymethylmethacrylate.

A third element (Element C) was prepared likewise Element A, but the eleventh layer contained beads of the copolymer of Example 2, dispersed according to Example 7, in an amount of 0.15 g. per sq.m., instead of polymethylmethacrylate.

Samples of the three elements were light exposed and developed at maximum density in the following sequence:

| | |
|---|---|
| Developer | 3'15" at 38° C. |
| Bleach | 4'30" at 38° C. |
| Washing | 1'05" at 38° C. |
| Fix | 4'20" at 38° C. |
| Washing | 3'15" at 38° C. |
| Stabilization | 1'05" at 38° C. |

the developer, bleach, fix and stabilization baths having the following compositions:

| | |
|---|---|
| Developer (composition for 1 liter at pH 10.05) | |
| hydroxylamine sulfate | 2.5 g |
| 4-amino-3-methyl-N—(β-hydroxyethyl)-aniline sulfate | 4.56 g |
| diethylentriaminopentacetic acid | 4.75 g |
| $K_2CO_3$ | 30.3 g |
| sodium sulfite | 4 g |
| Bleach (composition for 1 liter at pH 5.70) | |
| ammonium bromide | 173 g |
| acetic acid 80% | 20 ml |
| EDTA $FeNH_4$ | 103 g |
| EDTA | 27 g |
| Fix (composition for 1 liter at pH 6.50) | |
| ammonium thiosulfate 60% | 800 ml |
| sodium sulfite | 4.6 g |
| sodium metabisulfite | 5.0 g |
| Stabilization (composition for 1 liter at pH 7.3) | |
| formaline 40% | 6.6 ml |
| polyoxyethylated lauryl alcohol 50% | 0.6 ml |

On these samples, the presence or absence of pinholes was evaluated, a defect known in the photographic art which consists of small spots of various colors caused by the fact that the particles of matting agents do not remain in the top layer, but move into the silver halide emulsion layers to displace the emulsion itself and to give rise after development to various color spots (in this example to blue-violet spots caused by the penetration of the particles into the blue-sensitive emulsion layer). On the same samples, after development, the number of particles of the remained matting agent and the presence of dust on the surface of the element were also evaluated. The results are reported in Table 2.

TABLE 2

| Element | Particles remained after processing | Pin-holes | Dust on the surface |
|---|---|---|---|
| A | all present | present | present |
| B | absent | absent | absent |
| C | 35% present | absent | absent |

We claim:

1. A method for providing a matt surface on a photographic material comprising a support base, one or more light-sensitive gelatin silver halide emulsion layers coated on said support base and a non light-sensitive outer gelatin layer coated on said layers, said method comprising the introduction into said outer layer of discrete particles in an amount of from 50 to 600 mg. per square meter, insoluble in water and substantially soluble in the alkaline processing solutions, of a copolymer containing a carboxyl group, said method being characterized by the fact that said particles, of an average diameter between 0.5 and 4 micron, are introduced into the coating composition of the outer layer as a dispersion of a methacrylic acid and ethylmethacrylate copolymer containing from 20 to 50 percent in weight of methacrylic acid, which dispersion is obtained by dispersing a solution of said copolymer in ethylacetate or water-including ethylacetate in a water solution of a hydrophilic colloid.

2. A photographic material, comprising a support base, one or more light-sensitive gelatin silver halide emulsion layers and an outer non light-sensitive gelatin layer containing discrete particles having an average diameter between 0.5 to 4 microns and being present in an amount of from 50 to 600 mg. per square meter, said particles insoluble in water and substantially soluble in alkaline processing solutions, of a carboxyl group containing copolymer in a matting amount, wherein said discrete particles comprise a copolymer of methacrylic acid and ethylmethacrylate containing from 20 to 50 percent in weight of methacrylic acid.

3. A photographic material according to claim 2, wherein the outer gelatin layer containing said discrete particles is an outer protective layer coated on a light-sensitive gelatin silver halide emulsion layer.

4. A photographic material according to claim 2, wherein the outer gelatin layer containing said discrete particles is a layer coated on the back of the support base, which carries on the front one or more gelatin silver halide emulsion layers.

5. A photographic material according to claim 3, wherein the gelatin light-sensitive silver halide emulsion layers are sensitized to different regions of the visible spectrum and associated with dye forming couplers.

6. A photographic material according to claim 4, additionally comprising discrete particles of alkali-insoluble matting agents in combination with water-insoluble and alkali-soluble discrete particles.

* * * * *

UNITED STATES PATENT AND TRADEMARK OFFICE

CERTIFICATE OF CORRECTION

PATENT NO. : 4,447,525

DATED : May 8, 1984

INVENTOR(S) : Angelo Vallarino and Lorenzo Vittore

It is certified that error appears in the above-identified patent and that said Letters Patent is hereby corrected as shown below:

Col. 1, line 55, "off" should read --of--.

Col. 2, line 2, "or" should read --of--.

Col. 4, line 24, "or" should read --of--.

Col. 4, line 63, "off" should read --of--.

Signed and Sealed this

*Eighteenth* Day of *June 1985*

[SEAL]

*Attest:*

DONALD J. QUIGG

*Attesting Officer* *Acting Commissioner of Patents and Trademarks*